US008458856B2

(12) United States Patent
Lee et al.

(10) Patent No.: US 8,458,856 B2
(45) Date of Patent: Jun. 11, 2013

(54) UPRIGHT TYPE CLEANER

(75) Inventors: Byoung In Lee, Suwon-si (KR); Jae Man Joo, Suwon-si (KR); Tae Seok Yoon, Anyang-si (KR); Hyung Il Jeon, Suwon-si (KR); Sung Cheol Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/010,881

(22) Filed: Jan. 30, 2008

(65) Prior Publication Data

US 2008/0209672 A1 Sep. 4, 2008

(30) Foreign Application Priority Data

Feb. 13, 2007 (KR) ..... 10-2007-0014904
Feb. 13, 2007 (KR) ..... 10-2007-0014905

(51) Int. Cl.
*A47L 5/10* (2006.01)
*A47L 5/26* (2006.01)

(52) U.S. Cl.
USPC ..... 15/391; 15/389

(58) Field of Classification Search
USPC ..... 15/391, 389
See application file for complete search history.

(56) References Cited

U.S. PATENT DOCUMENTS

| | | | | | |
|---|---|---|---|---|---|
| 2,114,099 | A * | 4/1938 | Becker | 15/391 |
| 2,397,541 | A * | 4/1946 | Foley | 15/391 |
| 2,581,962 | A * | 1/1952 | Langille et al. | 15/372 |
| 2,584,495 | A * | 2/1952 | Osborn | 15/333 |
| 2,657,417 | A * | 11/1953 | Howard | 15/337 |
| 2,724,141 | A * | 11/1955 | Humphrey | 15/350 |
| 2,785,431 | A * | 3/1957 | Pardee | 15/368 |
| 4,167,801 | A * | 9/1979 | Erbor et al. | 15/354 |
| 4,490,882 | A * | 1/1985 | Wells | 15/337 |
| 4,685,171 | A * | 8/1987 | Beaudoin | 15/391 |
| 5,309,601 | A * | 5/1994 | Hampton et al. | 15/339 |
| 6,006,402 | A * | 12/1999 | Maurer et al. | 15/383 |
| 2006/0248680 | A1 * | 11/2006 | Heidenga et al. | 15/387 |

FOREIGN PATENT DOCUMENTS

KR 10-0548271 1/2006

* cited by examiner

*Primary Examiner* — Bryan R Muller
(74) *Attorney, Agent, or Firm* — Staas & Halsey LLP

(57) ABSTRACT

An upright type cleaner that uniformly provides a suction force through the whole area of a suction port. The upright type cleaner includes a body having a fan motor that generates suction force, a suction brush provided at a lower portion of the body and having a suction port to perform a cleaning operation relative to a floor using the suction force, a rotating drum installed in the suction brush, a belt connected between the rotating drum and the fan motor, a belt cover that guides the belt and divides the suction port into two suction areas, and a connection path through which the two suction areas are communicated to each other about the belt cover.

4 Claims, 8 Drawing Sheets

UPRIGHT TYPE CLEANER

CROSS-REFERENCE TO RELATED APPLICATIONS

This application claims the benefit of Korean Patent Application Nos. 10-2007-0014905, filed on Feb. 13, 2007, and 10-2007-0014904, filed on Feb. 13, 2007, in the Korean Intellectual Property Office, the disclosures of which are incorporated herein by reference.

BACKGROUND

1. Field

The present invention relates to an upright type cleaner. More particularly, the present invention relates to an upright type cleaner, in which a belt cover divides a suction port into two suction areas and a connection path connects the two suction areas divided about the belt cover, thereby improving suction efficiency.

2. Description of the Related Art

In general, an upright type cleaner includes an upright type body, in which a driving motor is installed to generate suction force, and a suction brush rotatably coupled to a lower portion of the upright type body.

A filtering unit and a dirt collecting box are provided in the upright type body, so that dirt introduced into the cleaner by means of the suction force of the driving motor is filtered through the filtering unit and then is collected in the dirt collecting box.

Such an upright type cleaner includes a suction port at a bottom surface of the suction brush, and a rotating drum is installed in the suction port to scatter dust sticking to a floor.

FIG. 8 is a perspective view showing a suction port of an upright type cleaner according to the related art.

The suction port 2 is formed at the bottom surface of a suction brush 1 to intake dust, a rotating drum 3 is installed in the suction port 2 in the transverse direction, and a spiral brush 4 is installed around the rotating drum 3.

A body (not shown) of the cleaner includes a fan motor (not shown) for driving the rotating drum 3 and a belt (not shown) is provided to connect a pulley of the fan motor with the rotating drum.

A belt cover 6 is provided at a lower case 5, which forms a lower portion of the suction brush 1, in order to guide the movement of the belt. The belt extends by passing through an upper portion of the suction port 2, so that the belt cover 6 divides the suction port 2 into two suction areas.

Meanwhile, a connection port (not shown) connected to the body is formed at one side of the suction brush 1, and a suction pipe (not shown) is connected to the connection port to output the suction force generated from the body, so that dust can be introduced into the cleaner through the suction port.

However, the suction force applied to the suction port 2 is reduced proportionally to the distance between the suction port 2 and the connection port. Especially, since the suction port 2 is divided into two suction areas by means of the belt cover 6, the suction force output from a suction port 2*a* positioned remotely from the connection port is significantly reduced due to interference by the belt cover 6, so the suction port 2*a* cannot easily suck the dust. For this reason, the suction area of the suction port 2 is substantially limited to a suction port 2*b* positioned at one side of the belt cover 6 in adjacent to the connection port.

In addition, a part of dust sucked through the suction port 2*b* cannot be directly introduced into the body, but move along the rotating drum 3, thereby lowering the suction efficiency. Further, the part of dust may flow back to the suction port 2*b*.

SUMMARY

Accordingly, it is an aspect of the present invention to provide an upright type cleaner capable of uniformly providing suction force through the whole area of a suction port.

Another aspect of the present invention is to provide an upright type cleaner capable of reducing the amount of dust that moves along a rotating drum during a suction process.

Additional aspects and/or advantages of the invention will be set forth in part in the description which follows and, in part, will be apparent from the description, or may be learned by practice of the invention.

The foregoing and/or other aspects of the present invention are achieved by providing an upright type cleaner including a body having a fan motor that generates suction force; a suction brush provided at a lower portion of the body and having a suction port to perform a cleaning operation relative to a floor using the suction force; a rotating drum installed in the suction brush; a belt connected between the rotating drum and the fan motor; a belt cover that guides the belt and divides the suction port into two suction areas; and a connection path through which the two suction areas are communicated to each other about the belt cover.

According to an aspect of the present invention, the connection path includes at least one of a lower connection path that crosses both sides of a lower portion of the belt cover and an upper connection path formed above the rotating drum while crossing both sides of the belt cover.

According to an aspect of the present invention, the lower connection path includes a suction guide that forms the suction port in the suction brush, and a path section extending from the belt cover toward the suction port to meet the suction guide.

According to an aspect of the present invention, the path section is inclined relative to the suction guide by a predetermined angle.

Further, according to an aspect of the present invention, the suction brush includes a lower case that forms a bottom of the suction brush, and the suction guide and the path section are integrally formed with the lower case.

According to an aspect of the present invention, a receiving cavity is formed in the suction path to receive the rotating drum therein, and the connection path is defined by a recess that protrudes outward from the receiving cavity.

According to an aspect of the present invention, the suction brush includes an upper case having the receiving cavity and the recess is formed at an upper portion of the upper case.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
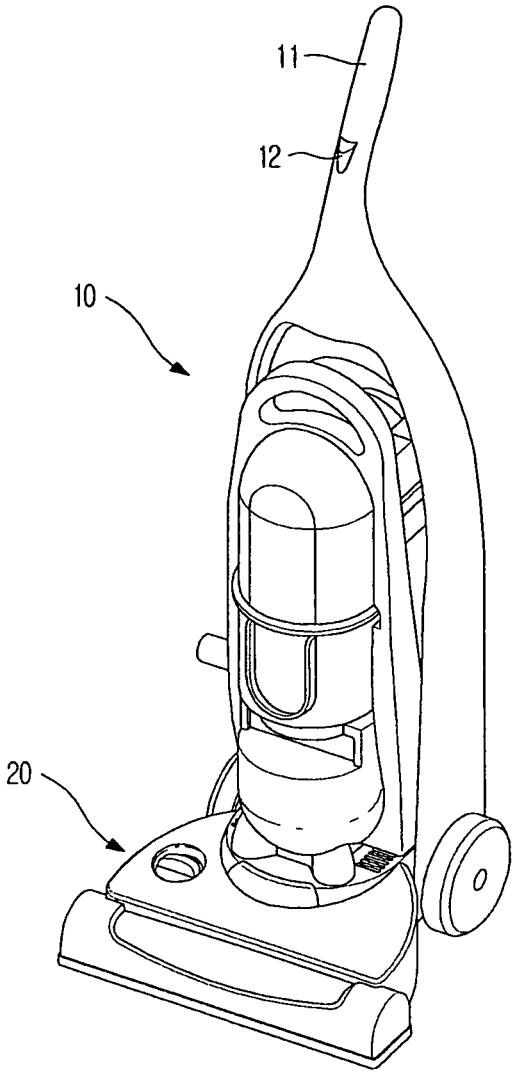
FIG. 1 is a perspective view showing an external appearance of an upright type cleaner according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
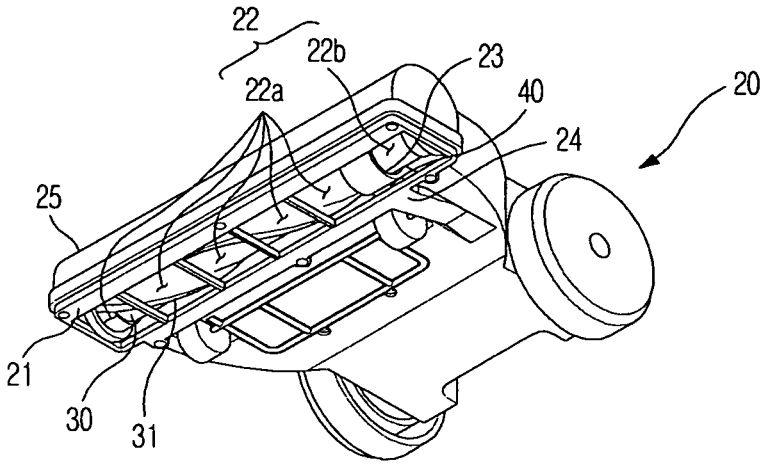
FIG. 2 is a perspective view showing a bottom of a suction brush shown in FIG. 1.
Figure 3:
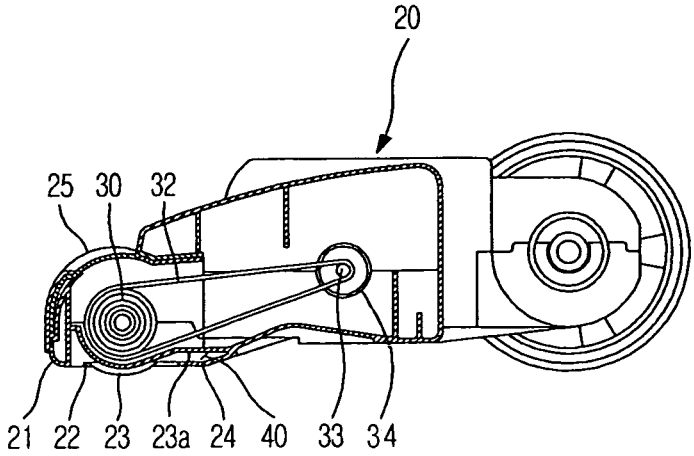
FIG. 3 is a side sectional view showing an internal structure of a suction brush.

FIG. 1 is a perspective view showing an external appearance of an upright type cleaner according to an embodiment of the present invention, FIG. 2 is a perspective view showing a bottom of a suction brush shown in FIG. 1, FIG. 3 is a side sectional view showing an internal structure of the suction brush.

The upright type cleaner according to the present invention includes a body 10 having a fan motor 34 that generates suction force, and a suction brush 20 rotatably coupled to a lower portion of the body 10.

A filtering unit and a dust collecting box are provided in the body 10, so that dust introduced into the cleaner by means of the suction force of the fan motor 34 is filtered through the filtering unit and then is collected in the dirt collecting box.

A handle 11 is provided at an upper portion of the body 10, and a switch 12 for controlling the operation of the fan motor 34 is provided in the handle 11.

Thus, the user operates the fan motor 34 by manipulating the switch 12 and then moves the cleaner using the handle 11, so that dust or impurities existing on the floor are introduced into the body 10 through the suction brush 20.

The suction brush 20 includes a suction port 22 at a bottom thereof, and a rotating drum 30 is installed in the upper portion of the suction port 22 lengthwise along the suction port 22. The suction brush 20 includes an upper case 25 having a receiving capacity for receiving the rotating drum 30, and a lower case 21 having a suction guide 24 and forming the suction port 22.

A spiral brush 31 is provided at an outer peripheral surface of the rotating drum 30 and the spiral brush 31 is exposed out of the suction port 22. As the rotating drum 30 rotates, the spiral brush 31 scatters dust or impurities sticking to the floor to guide the dust or impurities into the suction port 22.

The rotating drum 30 is driven by the fan motor 34 installed in the body 10. In order to transfer the driving force of the fan motor 34 to the rotating drum 30, a belt 32 is provided between a rotating shaft 33 of the fan motor 34 and the rotating drum 30.

The fan motor 34 is installed in the body 10 and positioned at the rear portion of the rotating drum 30. Thus, the belt 32 is perpendicular to an axial direction of the rotating drum 30 and is moved according to the operation of the fan motor 34.

The belt 32 crosses one side of the suction port 22 in the front and rear direction of the suction port 22, and the belt cover 23 is installed in the lower case 21 to protect and guide the belt 32.

The belt cover 23 surrounds the lower portion of the belt 32 in order to protect the belt 32 from dust that is introduced through the suction port 22. Thus, the lower end portion of the belt cover 23 crosses the suction port 22 in the front and rear direction of the suction port 22.

Therefore, the suction port 22 is divided into two suction areas about the belt cover 23, that is, the suction port 33 is divided into a first suction area 22*a* corresponding to one side of the belt cover 23 and a second suction area 22*b* corresponding to the other side of the belt cover 23.

A connection path 40 is formed at the lower portion of the belt cover 23 to allow the first suction area 22*a* to communicate with the second suction area 22*b*.

The connection path 40 is provided between the lower surface of the belt cover 23 and the upper surface of the suction guide 24 in order to prevent the suction force of the second suction area 22*b* from being lowered relative to the suction force of the first suction area 22*a* by the belt cover 23.

The belt cover 23 includes a path section 23*a* that extends toward the suction port 22. The suction guide 24 is positioned at the lower portion of the path section 23*a*.

The path section 23*a* is inclined relative to the suction guide 24 by a predetermined angle, so that the path section 23*a* meets the suction guide 24. Thus, as shown in FIG. 3, a space having a triangular shape is formed between the path section 23*a* and the suction guide 24. This space is defined as the connection path 40.

The suction guide 24 and the path section 23*a* are integrally formed with the lower case 21 having the suction port 22. When the lower case 21 is fabricated through injection molding, a slide core scheme is adopted to extend the path section 23*a* toward the suction port 22 such that the connection path 40 can be formed.

Figure 4:
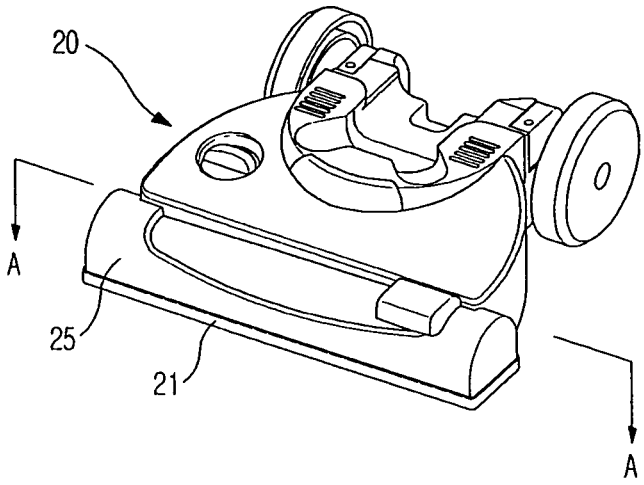
FIG. 4 is a perspective view showing a suction brush of an upright type cleaner according to another embodiment of the present invention.
Figure 5:
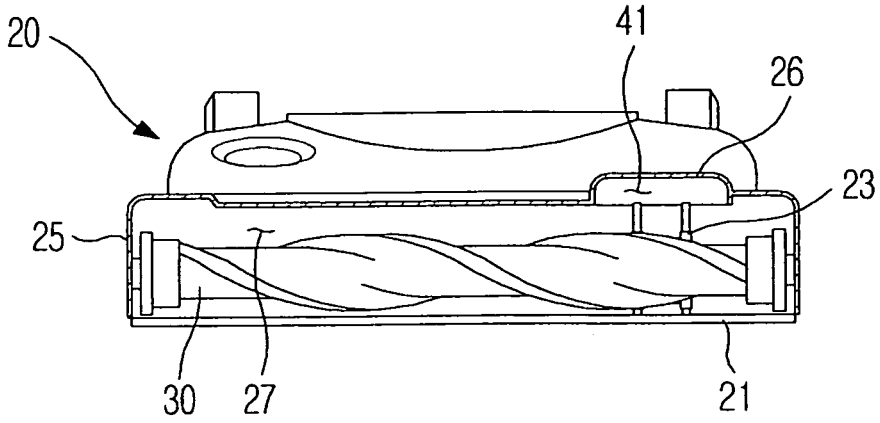
FIG. 5 is a sectional view taken along line A-A shown in FIG. 4.

FIG. 5 is a sectional view taken along line A-A shown in FIG. 4.

Referring to FIGS. 4 and 5, the suction brush 20 includes the upper case 25 and the lower case 21. The upper case 25 has a receiving cavity 27 in which the rotating drum 30 is rotatably installed.

A connection port (not shown) is formed at one side of the suction brush 20 and is connected to the body in such a manner that the suction force generated from the body can be transferred to the connection port. The receiving cavity 27 forms a suction path connected between the connection port and the suction port.

According to the present embodiment, the connection path 41 is formed above the belt cover 23 such that both sides of the receiving cavity 27, which is divided by the belt cover 23, can be connected each other. In detail, a recess 26, which is provided above the belt cover 23 while crossing the belt cover 23 in the length direction of the rotating drum 30, is formed at an inner portion of the upper case 25 having the receiving cavity 27. The recess 26 forms the connection path 41.

Due to the recess 26 formed in the upper case 25, a portion of the upper case 25 corresponding to the connection path 41 protrudes outward.

As the connection path 41 is formed, the section area of the suction path that connects both sides of the receiving cavity 27 aligned at both sides of the belt cover 23 can be increased. Accordingly, the suction force of the suction area, which is remote from the connection port, can be prevented from being significantly lowered by the belt cover 23 that blocks the receiving cavity 27.

The connection paths 40 and 41 according to the above two embodiments have the same functions in that they can connect the suction areas to each other at both sides of the belt cover 23, but they have positions and shapes different from each other. That is, the connection paths 40 and 41 are independent from each other, so they can be formed in any one of the upper case 25 and the lower case 21, or they can be formed in both of the upper case 25 and lower case 21.

Figure 6:
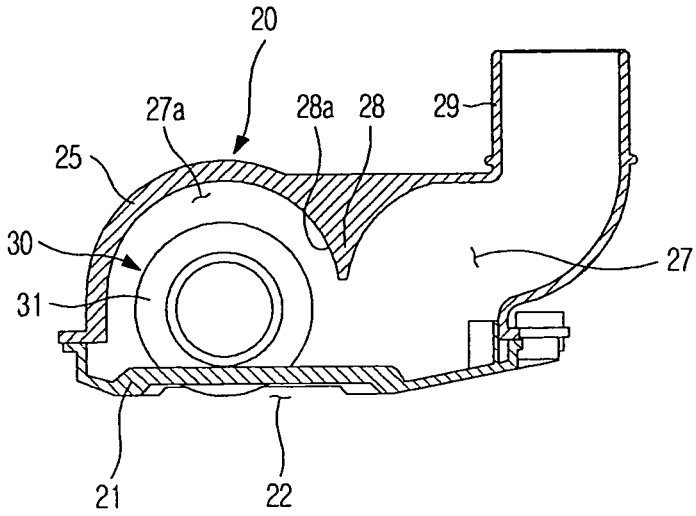
FIG. 6 is a side sectional view showing an internal structure of a suction brush according to another embodiment of the present invention.
Figure 7:
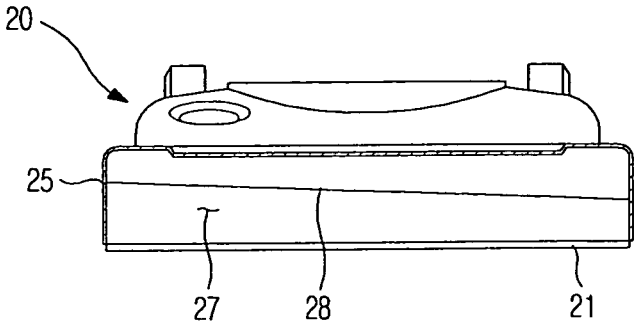
FIG. 7 is a front sectional view showing an internal structure of a suction brush of FIG. 6.
Figure 8:
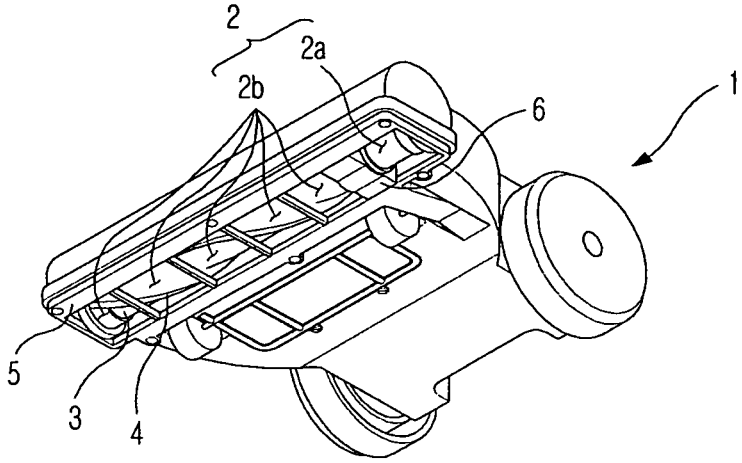
PRIOR ART FIG. 8
FIG. 8 is a perspective view showing a structure of a suction port of an upright type cleaner according to a related art.

FIG. 6 is a side sectional view showing an internal structure of a suction brush according to another embodiment of the present invention and FIG. 7 is a front sectional view showing the internal structure of the suction brush of FIG. 6.

A brush 31 is installed at an outer peripheral surface of the rotating drum 30. The brush 31 is exposed out of the suction port 22 in order to guide impurities such as dust sticking to the floor to the suction port 22 when the rotating drum 30 rotates.

The rotating drum 30 is driven by a fan motor provided in the body 10. The driving force of the fan motor is transferred to the rotating drum 30 through a belt so that the rotating drum 30 is rotated.

A connection port 29 is provided at one side of the suction brush 20. The connection port 29 is connected to the body 10 such that the suction port 22 can suck dust as the suction force is generated from the body 10.

A suction pipe (not shown) connected to the body 10 is coupled with the connection port 29. Thus, an internal space of the suction brush 20 between the suction port 22 and the connection port 29 forms a suction path 27 to which the suction force is applied.

The suction path 27 is provided with a partition 28 to guide dust sucked through the suction port 22 into the connection port 29 without allowing the dust to move along the rotating drum 20.

The partition 28 is a protrusion formed in the suction path 27 and extends along the axial direction of the rotating drum 30 corresponding to the length of the rotating drum 30 and the suction port 22.

The suction port 22 is formed at the bottom of the suction brush 20. Thus, the partition 28 that prevents dust from moving along the rotating drum 30 protrudes downward from the top of the suction path 27.

Since the partition 28 protrudes in the suction path 27, the sectional area of the suction port 27 is reduced. Therefore, velocity of air introduced into the suction path 27 may increase due to the partition 28, so that dust sucked through the suction port 22 may not move along the rotating drum 30, but be introduced into the connection port 29.

In addition, the partition 28 is designed such that the height of the partition 28 gradually increases proportionally to the distance with respect to the connection port 29.

The reason for varying the height of the partition 28 in the axial direction of the rotating drum 30 is that the suction force applied to the suction force 22 varies in the axial direction of the rotating drum 30.

In detail, the connection port 29, through which the suction brush 20 is connected to the body 10, is formed at one side of the suction brush 20. Thus, the suction force applied to the suction port 22 is reduced proportionally to the distance with respect to the connection port 29. Accordingly, the velocity of air sucked through the suction port 22 is also reduced proportionally to the distance with respect to the connection port 29.

Therefore, dust sucked through the suction port located remote from the connection port 29 may have velocity lower than that of dust sucked through the suction port located adjacent to the connection port 29. Accordingly, dust having the lower velocity may move along the rotating drum 30.

In order to compensate for the bad influence caused by difference in suction force, the height of the partition 28 is increased proportionally to the distance with respect to the suction port 29. In this case, the sectional area of the suction path 27 is reduced corresponding to the height of the partition 28, so that velocity of air introduced into the suction path 27 may increase. Thus, it is possible to directly guide the dust into the connection port 29.

Since the partition 28 protrudes in the suction path 27, the sectional area of the suction path 27 is reduced due to the partition 28. This configuration may cause a swirl flow in the suction path 27, resulting in greater suction noise.

To solve this problem, the partition 28 is provided with an inclined guide section **28*a* that is formed in the circumferential direction of the rotating drum 30. Due to the inclined guide section 28*a*, the air flow is not suddenly changed in a receiving cavity 27*a***, thereby preventing noise caused by the swirl flow.

As described above, the upright type cleaner according to the present invention includes the suction brush having the connection path that connects the suction areas at both sides of the belt cover.

Due to the connection path, the suction force generated from the body can be sufficiently transferred to the suction area, which is remote from the connection port, so that the suction port can easily suck dust or impurities, thereby improving the suction efficiency.

In addition, the upright type cleaner according to the present invention includes the partition protruding into the suction path of the suction brush.

Due to the partition, dust sucked through the suction port may not move along the rotating drum, but be introduced into the body through the connection port, so that the dust collecting efficiency of the upright type cleaner can be improved.

Although few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An upright type cleaner comprising:

a body comprising an upper and lower casing and having a fan motor that generates suction force;

a suction brush head provided at a lower portion of the body, having a front and rear portion and having a suction port at a bottom thereof;

a rotating drum installed in an upper portion of the suction port;

a belt connected between the rotating drum and the fan motor;

a belt cover that guides the belt, the belt cover surrounding a lower portion of the belt and a lower portion of the rotating drum in order to protect the belt from dust that is introduced through the suction port, the lower end portion of the belt cover crossing the suction port in from the front portion to the rear portion and dividing the suction port into two suction areas; and a connection path through which the two suction areas are communicated to each other, located rearward of the suction port, wherein the connection path comprises a lower connection path that crosses both sides of a lower portion of the belt cover, the lower connection path being defined by a suction guide that forms the suction port in the suction brush head, and a fixed path section extending from the belt cover toward the rear of the brush head to meet the suction guide, and the fixed path section being integrally formed with the suction guide and the lower casing;

wherein the belt cover extends a predetermined distance to cover the belt, wherein the predetermined distance is less than the front to rear distance between the rotating drum and the fan motor.

2. The upright type cleaner as claimed in claim 1, wherein the suction brush head comprises a lower case that forms a bottom of the suction brush, and the suction guide and the path section are integrally formed with the lower case.

3. The upright type cleaner as claimed in claim 1, wherein a receiving cavity is formed in the suction path to receive the rotating drum therein, the connection path further comprises an upper connection path formed above the rotating drum while crossing both sides of the belt cover, and the upper connection path is defined by a recess that protrudes outward from the receiving cavity.

4. The upright type cleaner as claimed in claim 3, wherein the suction brush head comprises an upper case having the receiving cavity and the recess is formed at an upper portion of the upper case.

* * * * *